US006634037B2

(12) United States Patent
Turbett et al.

(10) Patent No.: US 6,634,037 B2
(45) Date of Patent: Oct. 21, 2003

(54) PERSONAL CLEANSING SYSTEM

(75) Inventors: James Lynn Turbett, Darien, CT (US); Natalie Charambura, Gray, ME (US)

(73) Assignee: Unilever Home and Personal Care, USA division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/022,074

(22) Filed: Dec. 17, 2001

(65) Prior Publication Data

US 2003/0110557 A1 Jun. 19, 2003

(51) Int. Cl.[7] ..... A47K 3/28
(52) U.S. Cl. ..... 4/605; 206/409; 221/46
(58) Field of Search ..... 4/605; 206/409; 221/46, 48, 49, 286

(56) References Cited

U.S. PATENT DOCUMENTS 4,462,507 A * 7/1984 Margulies ..... 206/409 X
4,553,275 A 11/1985 Goldstein ..... 4/605
4,570,820 A * 2/1986 Murphy ..... 221/45 X
4,915,257 A 4/1990 Bailey ..... 221/48
5,076,424 A 12/1991 Nakamura ..... 206/409 X
5,273,184 A 12/1993 Rizzuto ..... 221/286 X
5,803,373 A 9/1998 Sedlock, Jr. et al. ..... 242/596.8

FOREIGN PATENT DOCUMENTS

| | | |
|---|---|---|
| EP | 1 078 594 A1 | 2/2001 |
| WO | 99/06311 | 2/1999 |
| WO | 00/33713 | 6/2000 |

* cited by examiner

*Primary Examiner*—Robert M Petsuga
(74) *Attorney, Agent, or Firm*—Alan A. Bornstein

(57) ABSTRACT

A personal cleansing system for substantially dry wiping articles is described suitable for use in a shower environment, utilizing a shell enclosing the wiping articles having a dispensing slot formed along the shell, a closure means, and a support device secured to the shell.

9 Claims, 15 Drawing Sheets

PERSONAL CLEANSING SYSTEM

BACKGROUND OF THE INVENTION

1. Field of the Invention

The present invention relates generally to a personal cleansing system and more particularly to personal cleansing system using a water-resistant wiping article dispenser and substantially dry wiping articles contained therein.

2. The Related Art

Disposable cleansing wiping articles are in widespread use for a variety of cleansing operations. Typically, these disposable wiping articles are individually folded and wrapped in flexible or rigid plastic or in metal foil-type packages. These wiping article dispensers suffer from the disadvantage that the user must open a lid or flap to retrieve an individual wiping article and in so doing, risk contaminating the other wiping articles or taking out more than one wiping article at a time. This is inconvenient and can potentially contaminate the entire stack of disposable wiping articles in the dispenser.

More recently it has been found that disposable cleansing wiping articles can serve as a disposable cleansing implement for personal hygiene in, for example, a shower or bath. In this instance it would be desirable to have a dispenser for disposable wiping articles that can be used in the shower or bath, that was not subject to contamination from the shower or by the user, was convenient to use, and facilitated dispensing one wiping article at a time in conjunction with personal cleansing.

U.S. Pat. No. 4,553,275 issued to J. Goldstein on Nov. 19, 1985 discloses a dispenser for soap-impregnated wash cloths adapted for mounting on a shower or bathroom wall. This dispenser is disadvantageous in that it may allow shower spray to contact and contaminate the wash cloths stored therein.

PCT publication WO 00/33713 to J. Spencer et al., published on Jun. 15, 2000 discloses a container and cartridge for dispensing controlled amounts of paper products. This dispenser is disadvantageous for use in a shower environment because the slot is exposed to shower spray, and the towels that are arranged adjacent to the slot may become contaminated with water from the shower.

EP Patent Application No. 1078594 to I. Fischer, published on Sep. 14, 2000, discloses a flat wiping article dispensing device which is designed to dispense paper or more moist towels and the like. This dispenser is likewise disadvantageous because the towels are dispensed through a side slot, which is exposed to contamination from shower spray. Fisher's device is also cumbersome to use because a panel must be depressed in order to cause a towel to be ejected from the side slot.

There is thus a need for a personal cleansing system comprising a substantially dry cleansing wiping article dispenser containing a plurality of wiping articles. Preferably the wiping articles are readily separable from a stack and are dispensed one at a time from a dispenser. The dispenser should be sealed from contamination from both the user and from the shower and both provide a way of securing the dispenser to the shower area and a sealing mechanism for preventing contamination of the wiping articles. It would be additionally desirable for the dispenser to accept a replacement refill conveniently.

SUMMARY OF THE INVENTION

In one aspect the inventive personal cleansing system utilizes a wiping article dispenser that is suitable for personal cleansing in the shower or bath and that both keeps the wiping articles dry and allows easy dispensing and refilling. Advantageously the cleansing wiping article dispenser is appropriately secured to the outside surface in the shower, such as a shower curtain rod or wall fixture so as to be convenient to use. Preferably wiping articles that are sufficiently stiff and flexible when wet for body washing application are used. More preferably these wiping articles are substantially dry before use.

In another aspect of this invention is a method for cleansing a human body within a water shower installation, comprising the steps of:

(a) providing a dispenser for a plurality of substantially dry, single use disposable wiping articles, each of the articles comprising a water-insoluble substrate and a lathering surfactant, the dispenser being water impermeable; the dispenser including:
  - a shell enclosing the plurality of wiping articles,
  - a slot formed along the shell having an opening bounded by a closure means displaceable between an open and a closed position, the open position allowing removal of the wiping articles, and
  - a support device secured to the shell;

(b) securing the dispenser via the support device to a member of the shower installation;

(c) removing a wiping article from the dispenser;

(d) lathering with water the removed wiping article;

(e) applying the lathered article to the body; and (f) rinsing the lathered body with a water spray.

As used herein, "substantially dry" means that the wiping articles of the present invention exhibit a Moisture Retention of less than about 0.3 gms, preferably less than about 0.25 gms, even more preferably, less than about 0.15 gms, and even more preferably less than about 0.1 gms. A suitable method for the determination of Moisture Retention is provided below. By a "lathering surfactant" is meant a surfactant, which when combined with water and mechanically agitated generates a foam or lather. Preferably the lathering surfactant concentration is in the range of about 0.1 to about 40% by weight of the wiping article. By "water insoluble" is meant the substrate does not dissolve or readily break apart upon immersion in water. Advantageously the wiping article further comprises a skin-conditioning agent other than a C8–C20 fatty acid in an amount from about 0.1 to about 40% by weight of the wiping article. Preferably the wiping articles are contained in a refill package.

The wiping article dispenser is advantageously secured to a member of a shower installation by a support device selected from mechanical couplers, suction couplers, adhesive, magnetic couplers, and combinations thereof. Preferably these are a hook, an adhesive, a VELCRO™ fastener, a cord and combinations thereof. Shower installation members are defined as any surface or fixture within or adjacent to a shower installation that is within reach of the user, e.g. shower walls, doors, plumbing fixtures, shower curtain rod, shelves, and the like. Advantageously the wiping article dispenser contains a plurality of wiping articles, preferably in the range of from about 2 to about 100. The wiping article dispenser protects the wiping articles from contacting the water spray from the shower. Preferably the dispenser prevents shower water from entering to an extent that any of the plurality of wiping articles absorb no more than about 5% by weight of shower water per article during the rinsing step, more preferably no more than about 2% by weight of shower water per article.

DETAILED DESCRIPTION

The foregoing features, advantages, and objects of this invention are now described in more detail in reference to the drawings in which like numbers represent like features.

Figure 1:
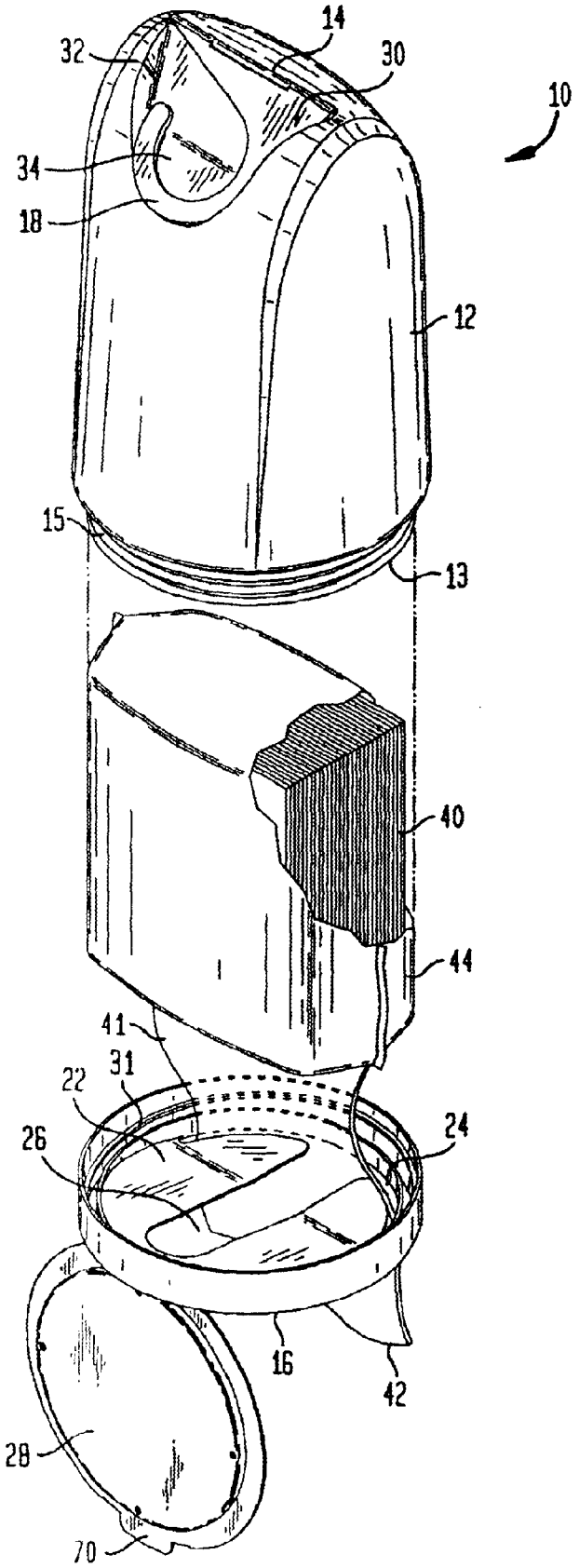
FIG. 1 is an exploded perspective view of a preferred embodiment of the wiping article dispenser and wiping article refill suitable for use with the inventive personal cleansing method, parts being broken away for clarity.
Figure 2:
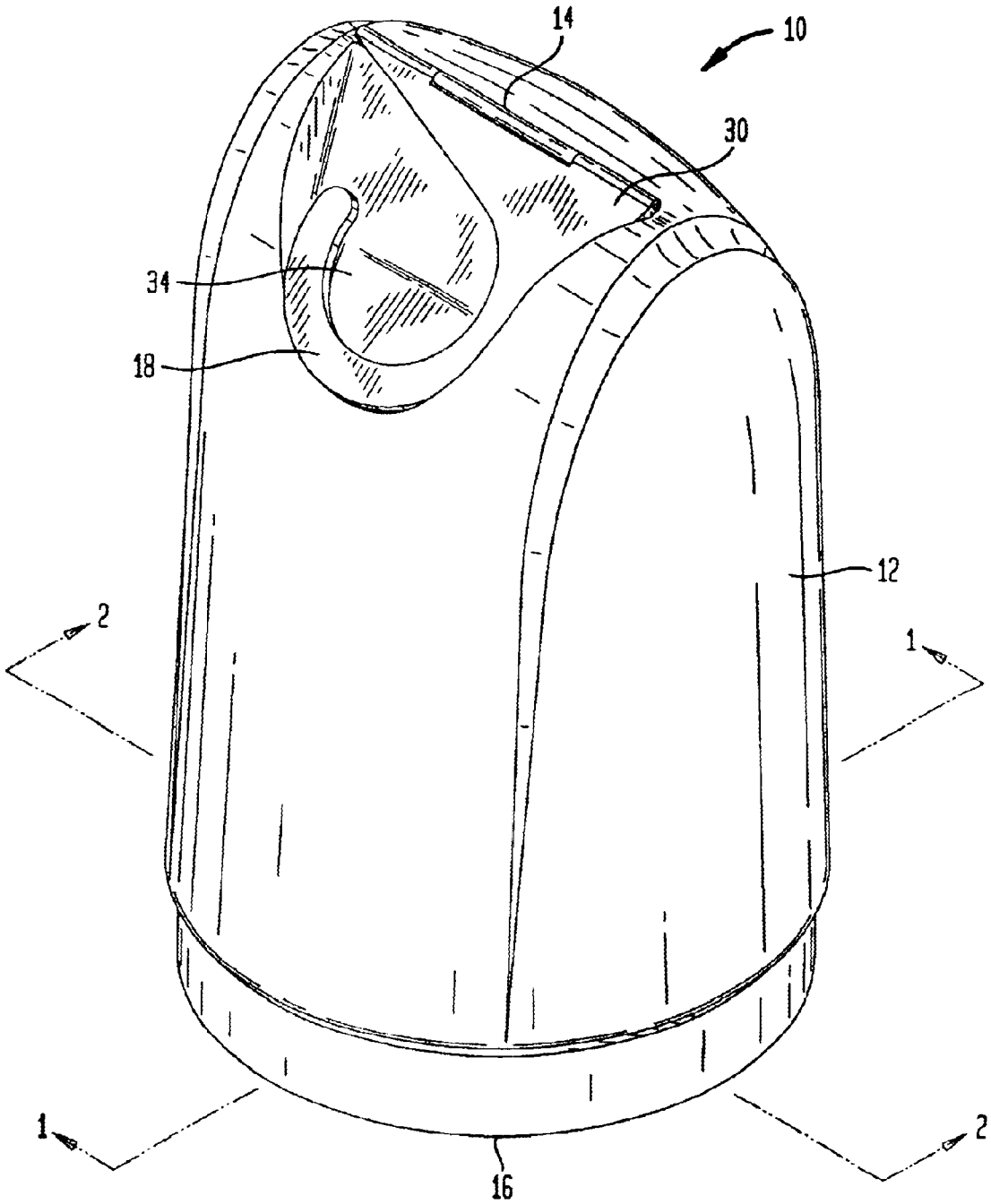
FIG. 2 is a perspective view of the wiping article dispenser shown in FIGS. 1 and 1A.
Figure 2B:
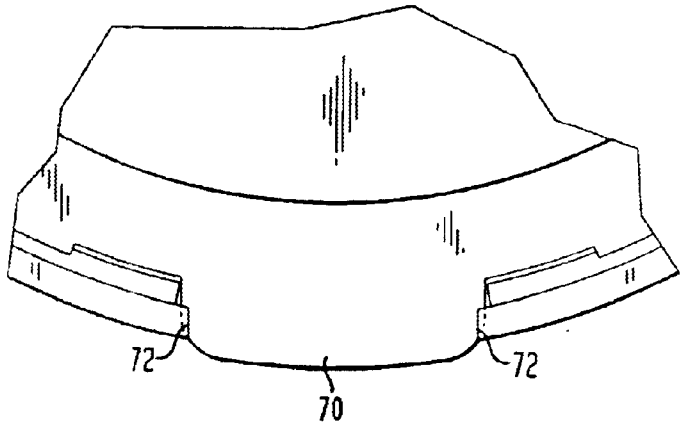
FIG. 2B is a detailed perspective view of the lid depicted in FIG. 2A engaging the end of the dispenser.
Figure 3:
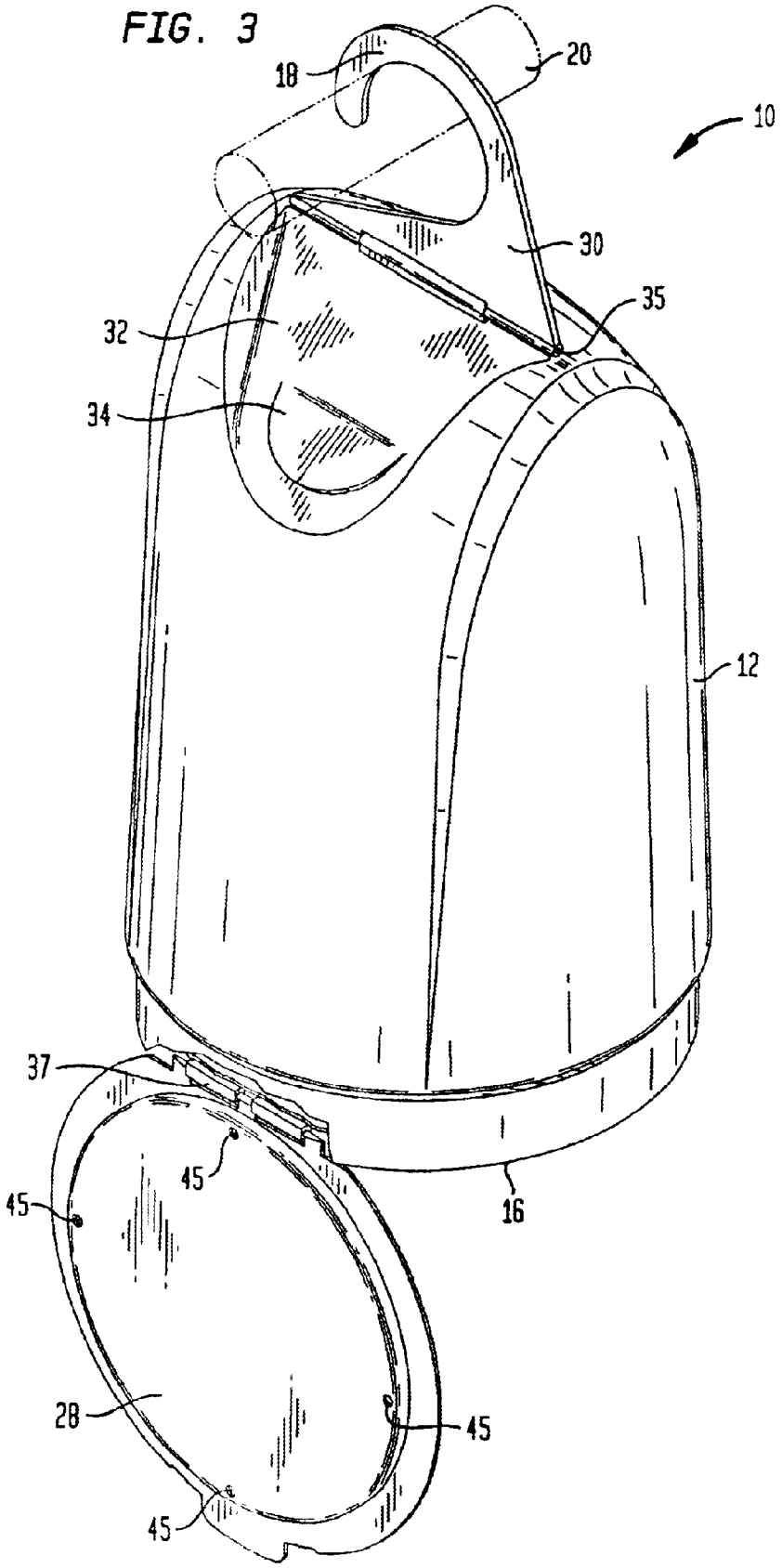
FIG. 3 is a perspective view of the wiping article dispenser shown in FIGS. 1–2, showing the hook and lid in an extended position.
Figure 4A:
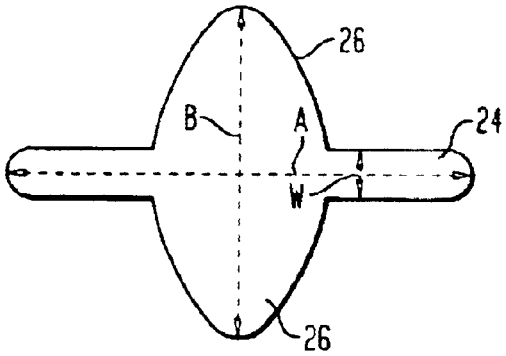
FIGS. 4A–G are bottom plan views of preferred embodiments of the dispensing slot and finger-access opening depicted in FIGS. 1 and 1A.
Figure 4B:
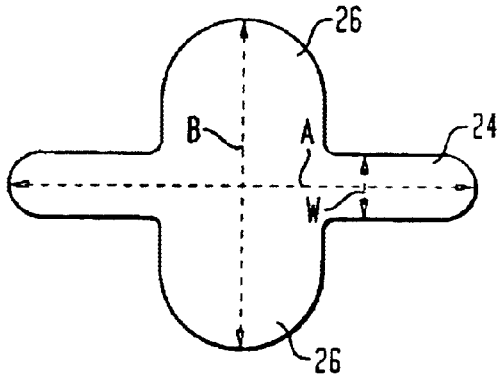
Figure 4C:
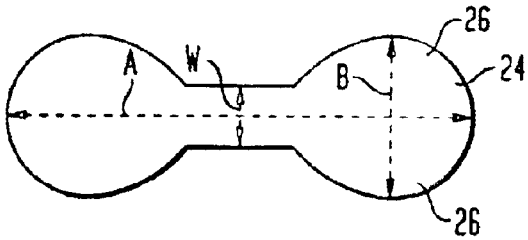
Figure 4D:
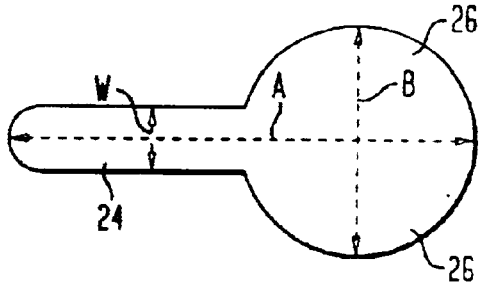
Figure 4E:
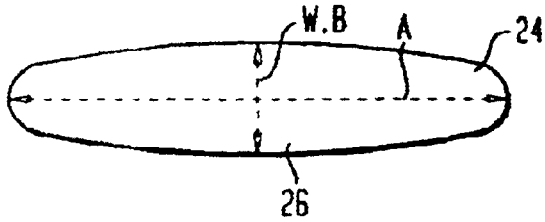
Figure 4F:
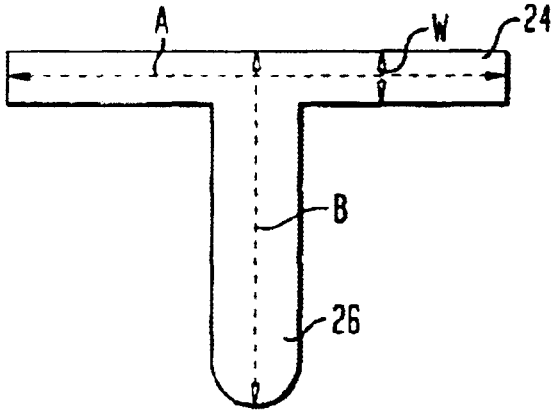
Figure 4G:
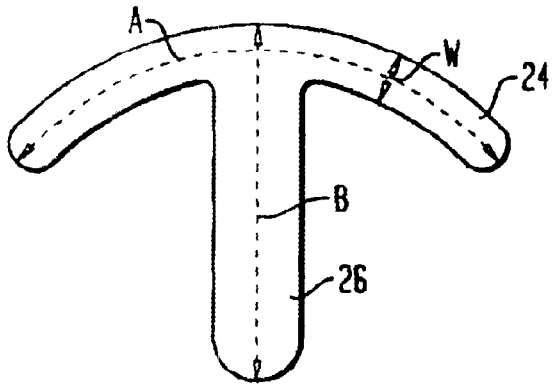

Referring now to FIGS. 1–3, a dispenser for wiping articles 10 suitable for use with the inventive personal cleansing method includes a shell 12 having an opposed first 14 and a second end or cap 16. A support device or hook 18 is pivotally connected to the shell 12 via base 30 and hinge 35 for securing the dispenser 10 to an outside surface 20. Hook 18 is pivotally mounted on shell 12 for movement between a retracted position shown in FIGS. 1–2 and an extended position shown in FIG. 3. In its retracted position, hook 18 is positioned in recessed portion 32 on shell 12, and in pressing engagement with protuberance 34. The cap 16 defines the bottom surface 22, which has a dispensing slot 24 and a finger-access opening 26. Lid 28 is pivotally coupled to the cap 16 via hinge 37 for movement between the closed position covering the dispensing and finger access openings 24 and 26, and an open position exposing the openings. In its closed position lid 28 is secured to cap 16 when tab 70 is moved into pressing engagement with locking tabs 72, shown in greater detail in FIG. 2B. Refill dispenser kit 44 containing a plurality of wiping articles 40 is shown being received in shell 12 of wiping article dispenser 10. Also shown, is a single wiping article 41 having leading edge 42 being dispensed through dispensing slot 24. Advantageously, cap 16 having threads 31 engages shell 12 having complementary thread 15.

Figure 1A:
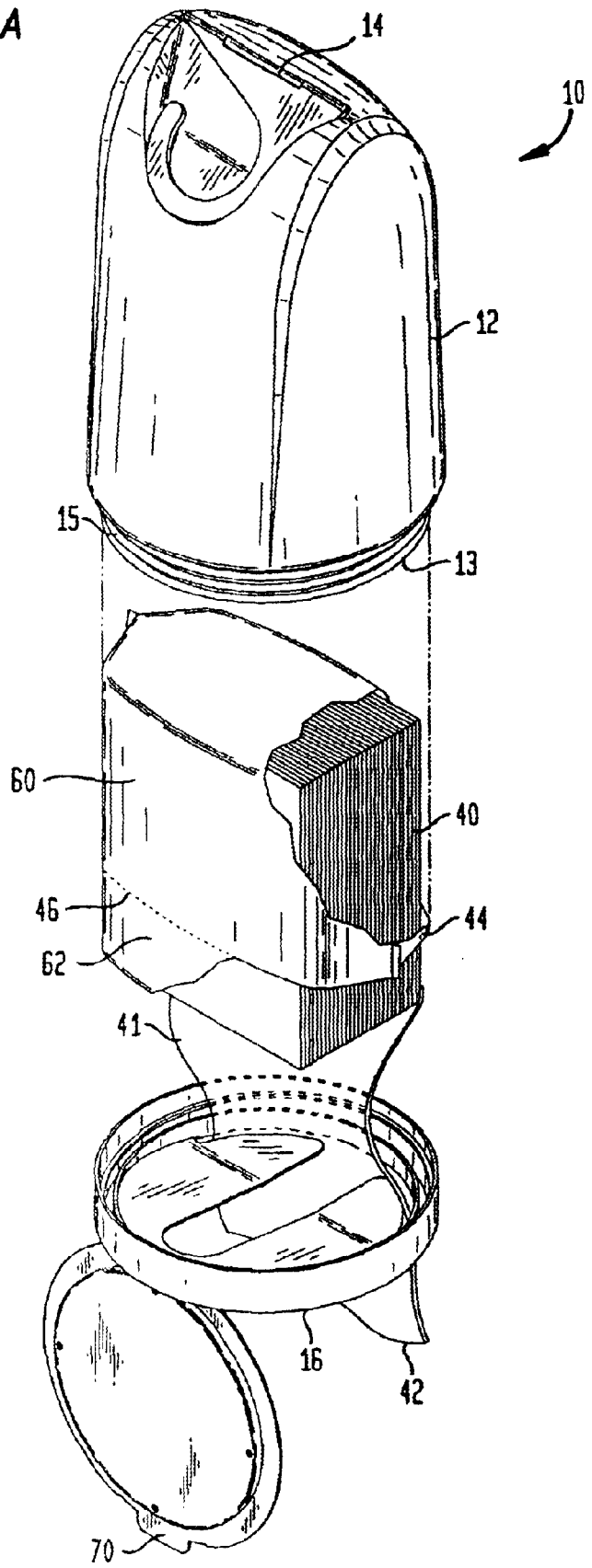
FIG. 1A is an exploded perspective view of the wiping article dispenser shown in FIG. 1 with a second preferred embodiment of the wiping article refill.

Now referring to FIG. 1A, another embodiment of refill kit 44 is depicted. Refill dispenser kit 44 is shown having an upper portion 60 and a base 62 wherein the upper portion is detachable along a line of weakness 46 exposing the plurality of wiping articles 40 and allowing wiping article 41 to be dispensed.

Figure 2A:
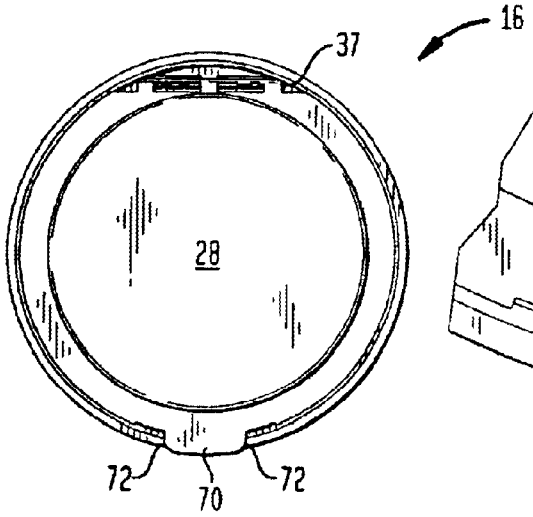
FIG. 2A is a bottom plan view of the wiping article dispenser shown in FIGS. 1–3 showing the lid in the closed position.

FIG. 2 is a perspective view of wiping article dispenser 10 showing hook 18 in a retracted position and lid 28 (not shown) in the closed position. FIGS. 2A and 2B show lid 28 having hinge 37 in its closed position when tab 70 engages locking tabs 72.

Figure 2C:
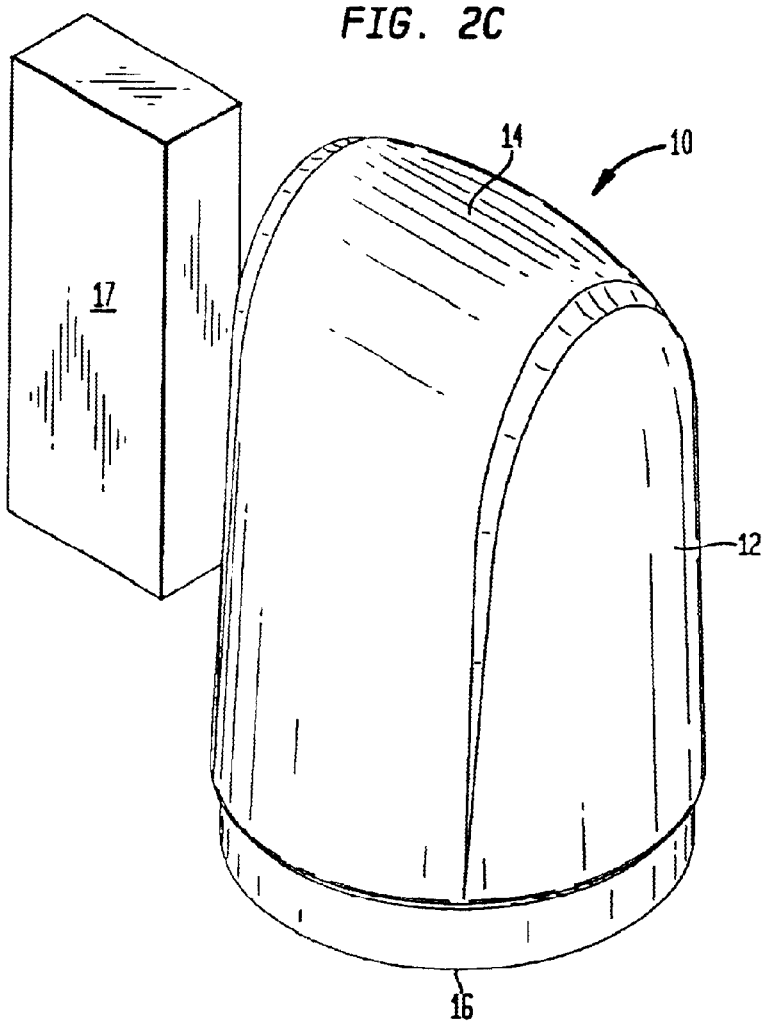
FIG. 2C is a perspective view of a second embodiment of the wiping article dispenser shown in FIGS. 1 and 1A.

FIG. 2C is a perspective view of wiping article dispenser 10 showing support device 17, which serves to support dispenser 10 in a convenient location. Support device 17 may include mechanical couplers, suction couplers, adhesive, magnetic couplers, and combinations thereof. Preferably the support device is selected from a hook, an adhesive, a VELCRO™ fastener; i.e. a closure consisting of a fabric of small hooks that sticks to a corresponding fabric of small loops (Merriam Webster New Collegiate Dictionary, 10th Edition, 1999), a cord and combinations thereof.

Now referring to FIG. 3, wiping article dispenser 10 is shown with hook 18 in extended position engaging outside surface 20. Also shown is lid 28 in the open position.

Now referring to FIGS. 4A–G, the respective length dimensions of each dispensing slot in FIGS. 4A–G are illustrated by broken line A. The respective width dimensions of each dispensing slot in FIGS. 4A–G are illustrated by broken line W. The respective length dimensions of each finger-access opening in FIGS. 4A–G are illustrated by broken line B. In some instances, for example in FIG. 4E, broken line W is coincident with broken line B. FIGS. 4A–G illustrate various dispensing and finger-access opening shapes which are suitable for dispensing cleansing wiping articles by sequentially positioning the leading edge of the cleansing wiping article via the finger access opening so that it is aligned with the dispensing slot and thus allowing a single wiping article to be grasped and then pulled through the slot.

Figure 5A:
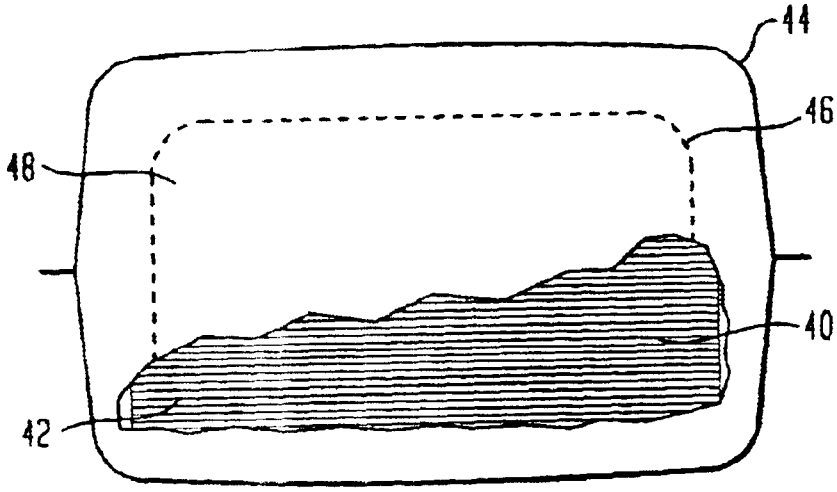
FIG. 5A is a bottom plan view of the wiping article dispenser refill shown in FIG. 1, parts being broken away for clarity.

Now referring to FIG. 5A, disposable wiping articles refill kit 44 contains a stack of a plurality of wiping articles 40 which is revealed in the cut-away portion of bottom panel 48. Bottom panel 48 is detachable from wiping article refill kit 44 along line of weakness 46, revealing the leading edge 42 of the plurality of the stack of wiping articles 40.

Figure 5B:
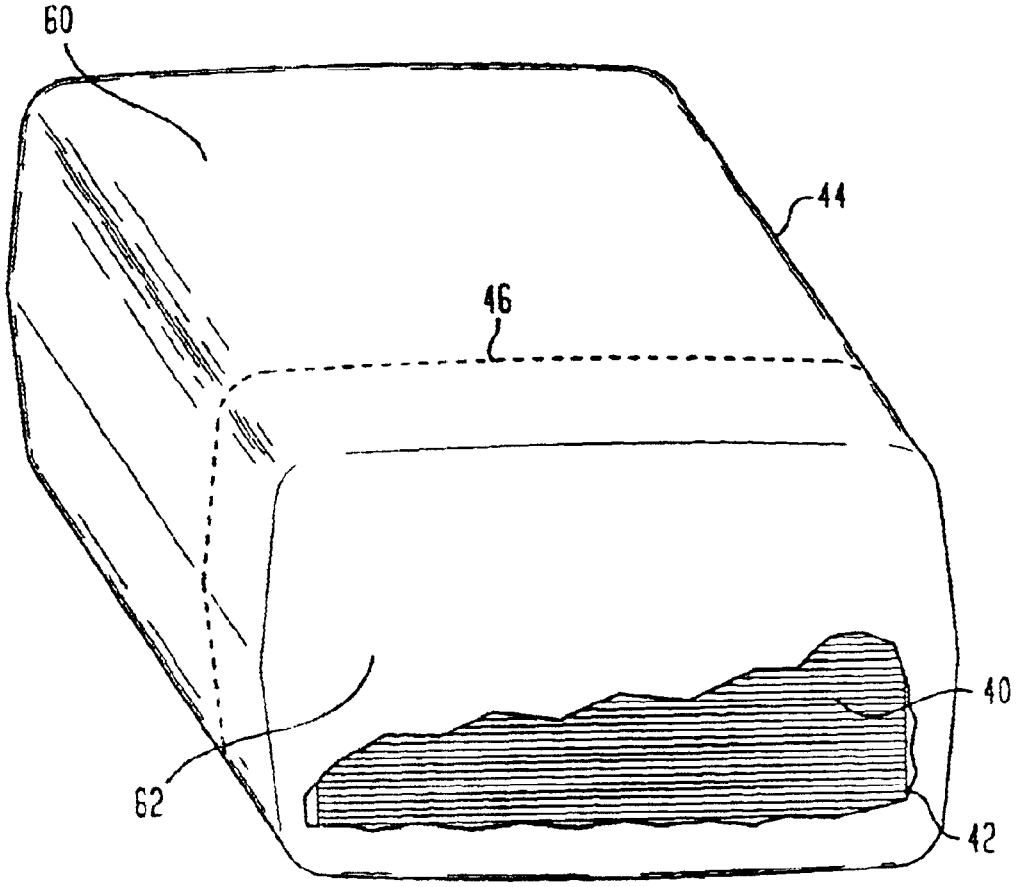
FIG. 5B is a perspective view of the wiping article dispenser refill shown in FIG. 1A, parts being broken away for clarity.

Now referring to FIG. 5B, disposable wiping articles refill kit 44 contains a stack of a plurality of wiping articles 40 which is revealed when base 62 is detached from upper portion 60 along line of weakness 46 revealing the leading edge 42 of the plurality of the stack of wiping articles 40.

Figure 5C:
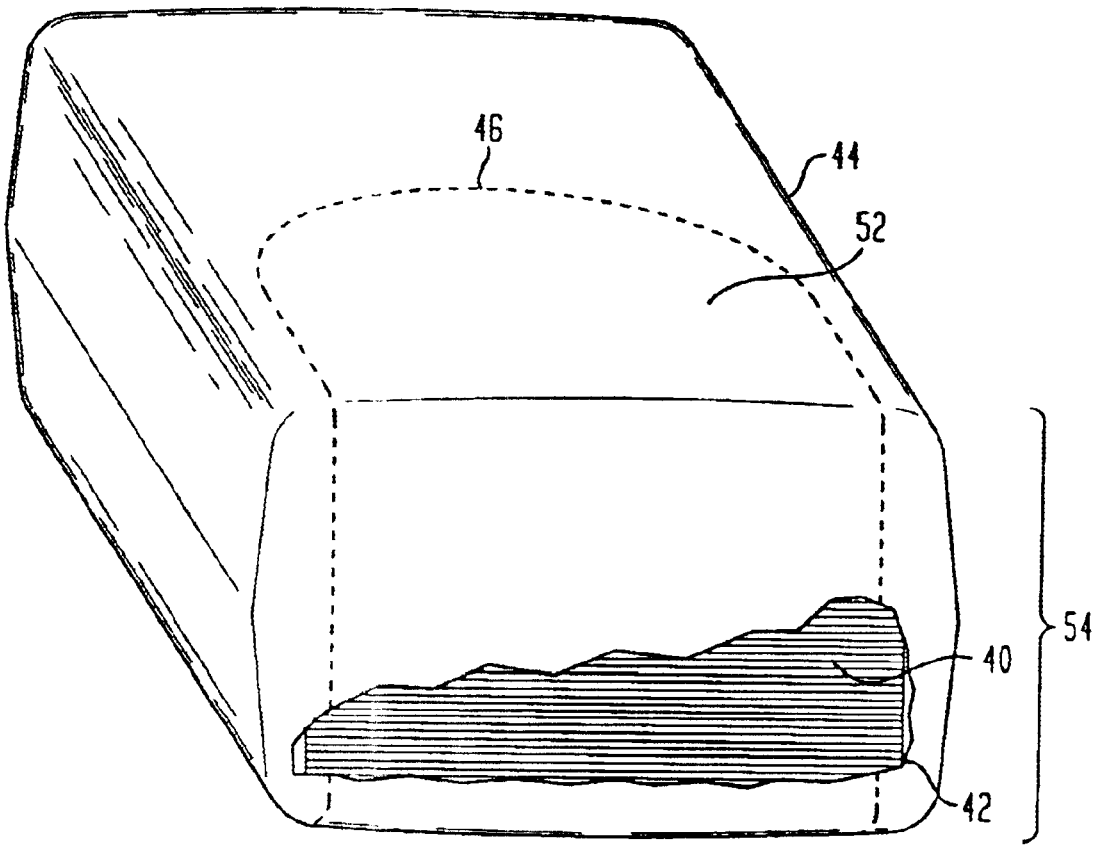
FIG. 5C is a perspective view of another preferred embodiment of a wiping article dispenser refill, parts being broken away for clarity.
Figure 6A:
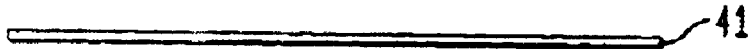
FIGS. 6A–F are side elevational views of preferred embodiments of the cleansing wiping article of the invention.
Figure 6B:
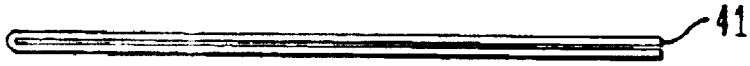
Figure 6C:
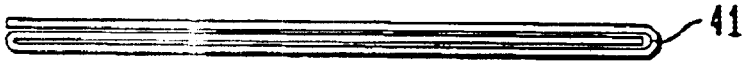
Figure 6D:
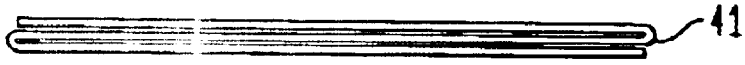
Figure 6E:
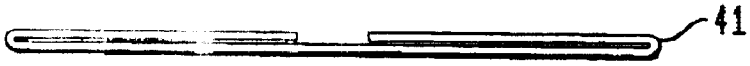
Figure 6F:
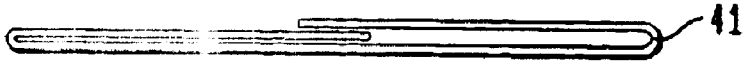
Figure 7:
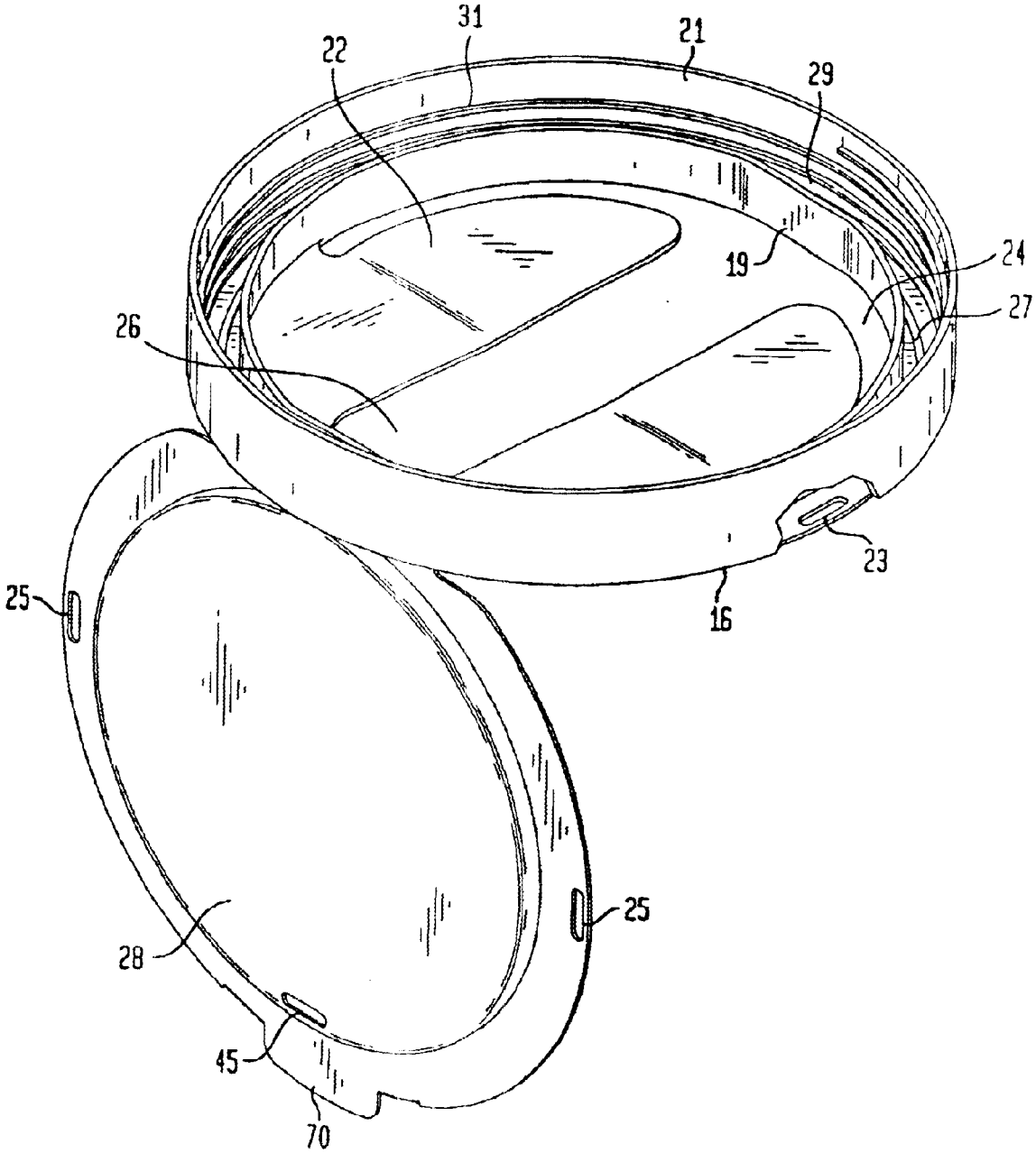
FIG. 7 is a perspective view of a preferred embodiment of the cap of the wiping article dispenser shown in FIGS. 1, 1A, 2, and 3.

Now referring to FIG. 5C, disposable wiping articles refill kit 44 contains a stack of a plurality of wiping articles 40 which is revealed in the cut-away portion of end panel 54. Saddle perforation panel 52 is detachable from wiping article refill kit 44 along line of weakness 46 revealing the major portion of the leading edge 42 of the plurality of the stack of wiping articles 40. Major portion as used herein, is defined as more than about 50% of the leading edge of the wiping article, preferably more than about 70% of the leading edge of the wiping article. In this context, the leading edge length dimension may be reduced by folding the wiping article into bi-, z-, or overlapping-fold configurations, for example, and the like. In the case of the folded wiping article the leading edge length dimension will be the length of the folded wiping article.

Referring now to FIGS. 6A–F are various embodiments of wiping article 41 shown in an unfolded (6A), bi-folded (6B), tri-folded (6C), z-folded (6D), c-folded (6E), and overlapping folded (6F) arrangement. Preferably, the unfolded or folded wiping articles are stacked and are not interfolded.

Figure 8:
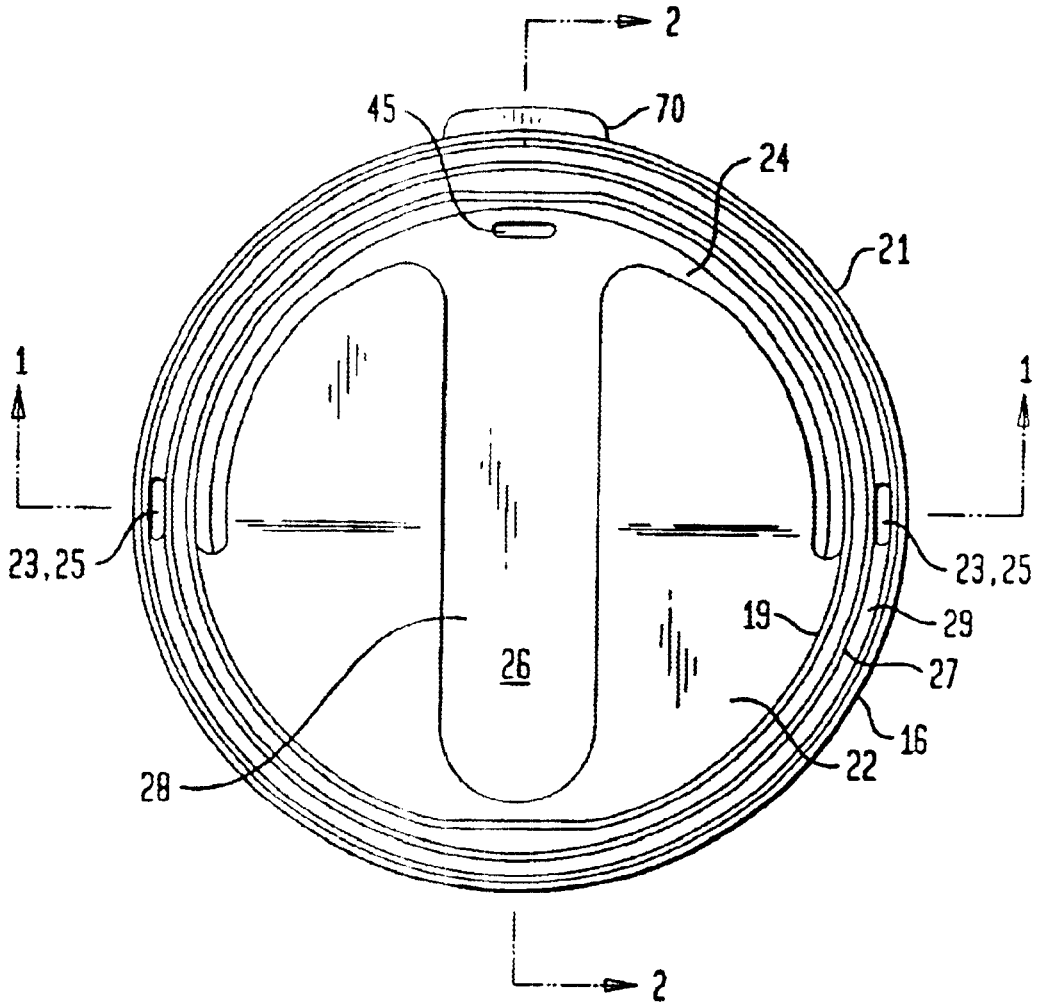
FIG. 8 is a top plan view of the cap of the wiping article dispenser shown in FIG. 7, with the lid in the closed position.
Figure 8A:
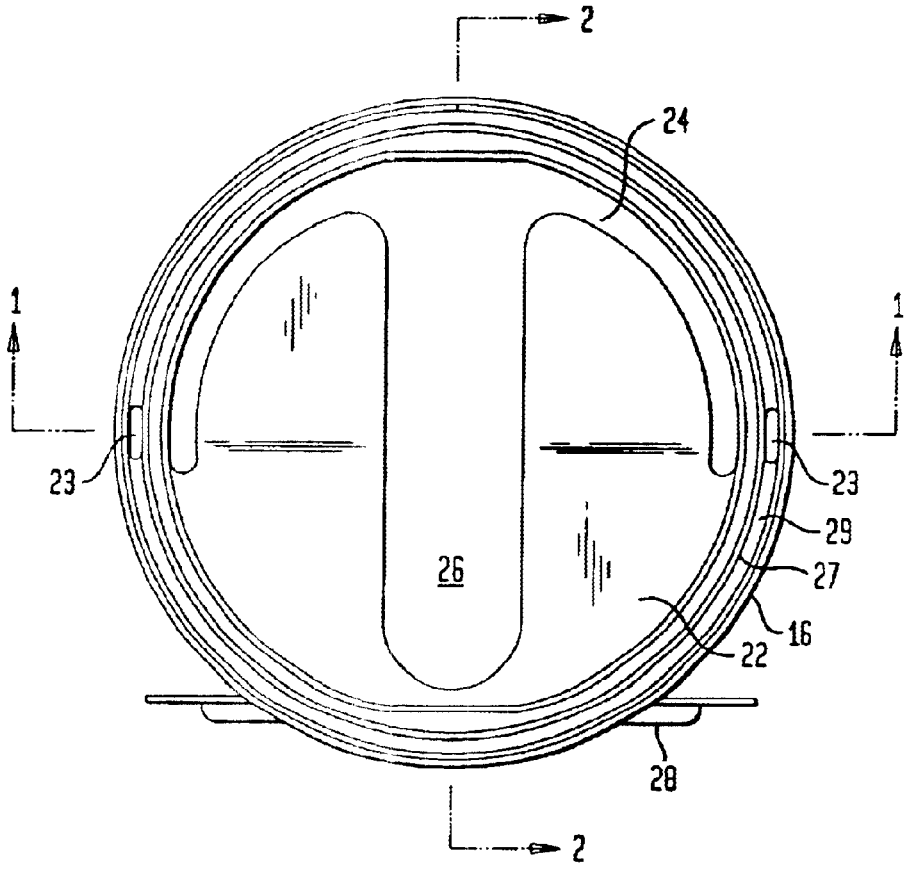
FIG. 8A is a top plan view of the cap of the wiping article dispenser shown in FIG. 7, with the lid in the open position.
Figure 9:
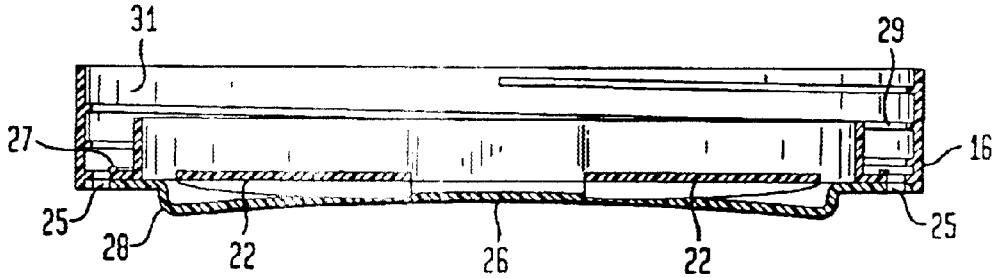
FIG. 9 is a cross-sectional view of the cap of the wiping article dispenser shown in FIG. 8, taken along line 1—1.
Figure 10:
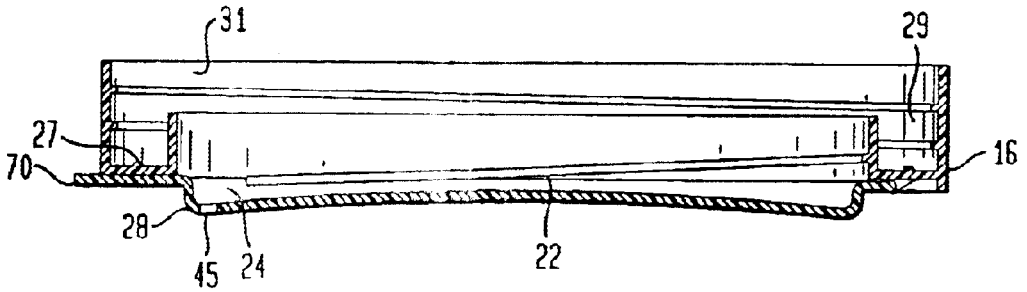
FIG. 10 is a cross-sectional view of the cap of the wiping article dispenser shown in FIG. 8, taken along line 2—2.

Now referring to FIG. 7–10, a preferred embodiment of cap 16 is depicted. The cap 16 defines the bottom surface 22 that is sloped downwardly towards the dispensing slot 24 for gravity assistance feeding the plurality of wiping articles 40 to the slot 24. Cap 16 also defines gutter 29 adapted for receiving rim 13 in a sealing relationship with the cap 16 when rim 13 is pressed in sealing engagement with seal 27. In the embodiment illustrated in FIG. 7, cap 16 threadably engages rim 13. Also illustrated is lid 28 pivotally coupled to the cap 16 via hinge 37 for movement between the closed position covering the dispensing and finger access openings 24 and 26 respectively as depicted in FIG. 8 and in the open position exposing the openings as depicted in FIG. 8A. Cap 28 contains drainage holes 25, which fluidly communicate, with drainage holes 23 in cap 16. Cap 28 also contains drainage hole 45, which fluidly communicates with dispensing slot 24. In operation, shower water spray will impinge on shell surface 12, run past threads 31 into gutter 29 and flow out of the dispenser via holes 23 and 25, without contacting the plurality of wiping articles contained within the dispenser. Shower water spray, which penetrates inside shell 12, will contact lid 28 and be directed towards drainage hole 45. 28 has a convex profile which facilitates the flow of water from the center towards the edge of the lid 28 and to drainage hole 45.

Figure 11:
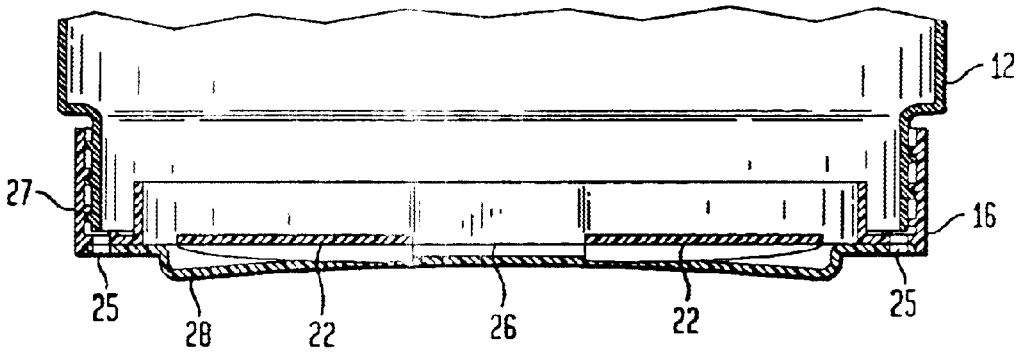
FIG. 11 is a partial cross-sectional view of a preferred embodiment of the cap shown in FIG. 2 in sealing engagement with the wiping article dispenser shell taken along line 1—1.
Figure 11A:
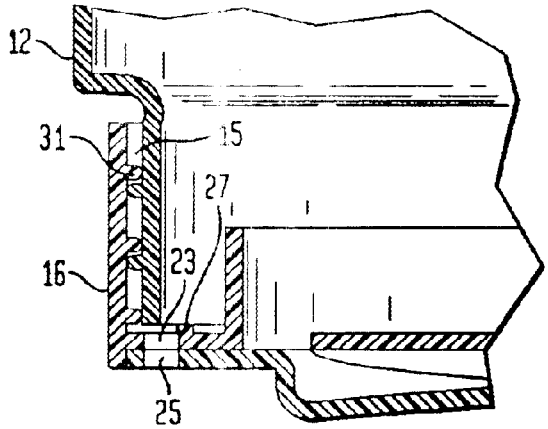
FIG. 11A is an enlarged partial cross-sectional view of the embodiment of FIG. 11.
Figure 12:
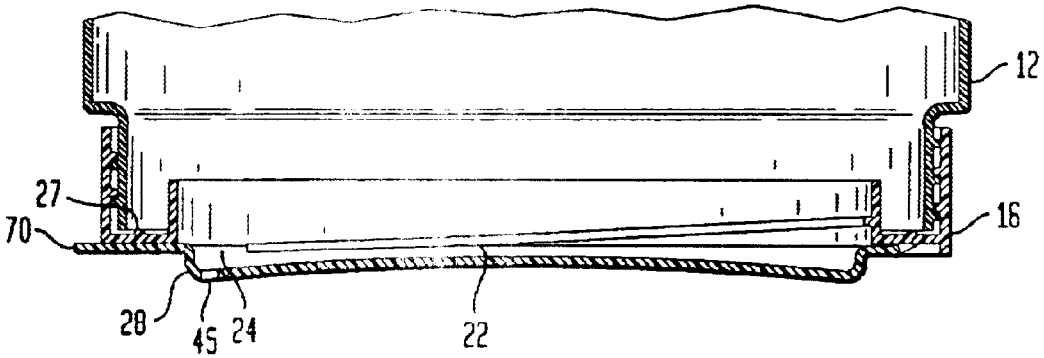
FIG. 12 is a partial cross-sectional view of a preferred embodiment of the cap shown in FIG. 2 in sealing engagement with the wiping article dispenser shell taken along line 2—2.

Now referring to FIGS. 11, 11A and 12, cap 16 is shown in sealing relationship with shell 12 via interlocking threads 16 and 15 whereby rim 13 is brought into sealing contact with sealing surface 27.

Figure 13:
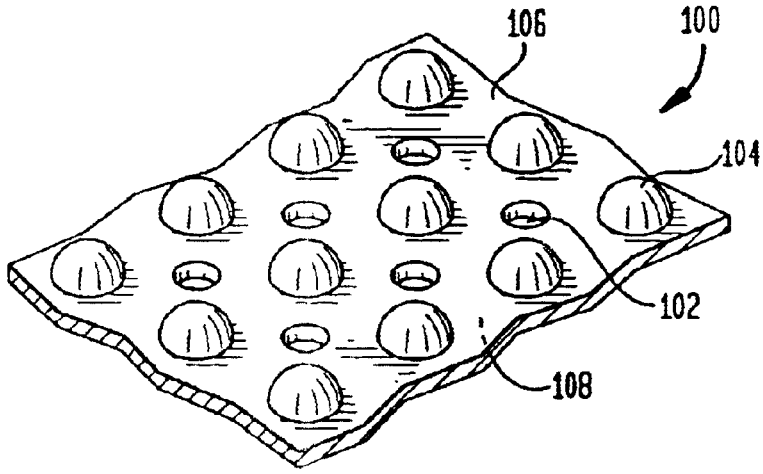
FIG. 13 is a schematic perspective view of a preferred embodiment of a wiping article suitable for use with the invention.
Figure 14:
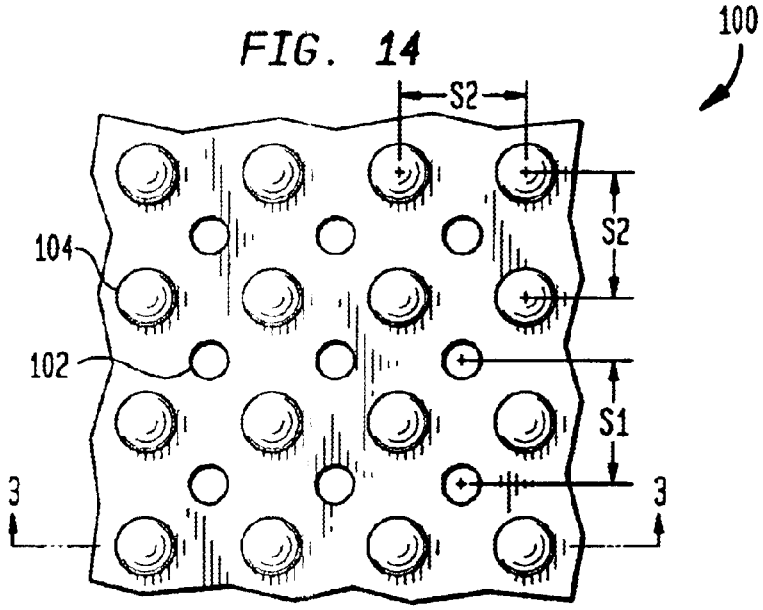
FIG. 14 is a top plan view of the wiping article shown in FIG. 13.
Figure 15:
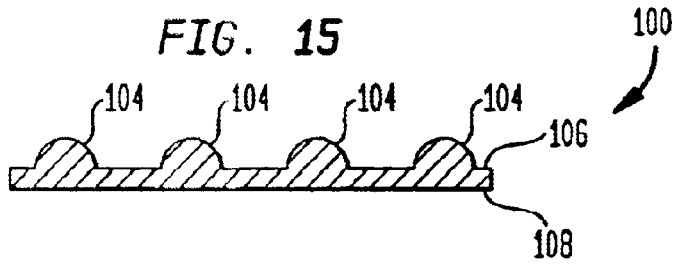
FIG. 15 is a cross-sectional view of the wiping article shown in FIG. 13, taken along line 3—3.

Now referring to FIGS. 13 to 15, a wiping article 100 suitable for use with the inventive personal cleansing method has top surface 106, bottom surface 108, a plurality of apertures 102, and a plurality of nubs 104. Apertures 102 are uniformly distributed throughout wiping article 100 and are spaced apart by centerline to centerline distance S1. Similarly, nubs 104 are uniformly distributed throughout wiping article 100 top surface 106, and are spaced apart by center-line to center-line distance S2.

Advantageously, the ratio of the slot width to the effective thickness of the uncompressed wiping article is in the range of about 1:2 to about 4:1, preferably from about 1:2 to about 3:1. Slot width is here defined as the narrowest portion of the slot through which the wiping article passes. The wiping article may be either in the folded or unfolded state. The effective thickness of the uncompressed wiping article can be the thickness of the wiping article or a multiple of the thickness of the wiping article depending on the degree of folding of the wiping article. Useful wiping articles that can be dispensed with the inventive dispenser possess a certain degree of loft such that they can be compressed before being pulled through the dispensing slot.

Wiping articles suitable for use with the inventive personal cleansing method are "substantially dry". As used herein, "substantially dry" means that the wiping articles of the present invention exhibit a Moisture Retention of less than about 0.3 gms, preferably less than about 0.25 gms, even more preferably, less than about 0.15 gms, and even more preferably less than about 0.1 gms. The Moisture Retention is indicative of the dry feel that users perceive upon touching the wiping articles of the present invention as opposed to the feel of "wet" wiping articles.

In order to determine the Moisture Retention of the present wiping articles and other disposable substrate- based products, the following equipment and materials are needed.

| | |
|---|---|
| Bounty ® White Paper Towel | Procter & Gamble SKU 37000 63037<br>Basis Weight = 42.14 gsm |
| Balance | Accurate to 0.0 g |
| Lexan ® | 0.5" thickness<br>large enough to cover samples completely and weighs 1000 g |
| Weight | A 2000 g weight or combination to equal 2000 g |

Next, weigh two paper towels separately and record each weight. Place one paper towel on flat surface (e.g. lab bench). Place the sample article on top of that towel. Place the other paper towel on top of sample article. Next, place the Lexan® and then the 2000 g weight(s) on top of the sandwiched sample article. Wait 1 minute. After the minute, remove weight(s) and Lexan®. Weigh the top and bottom paper towel and record the weight.

Calculate the Moisture Retention by subtracting the initial paper towel weight from the final weight (after 1 minute) for both the top and bottom paper towels. Add the weight differences obtained for the top and bottom paper towels. Assuming multiple wiping articles are tested, average the total weight differences to obtain the Moisture Retention.

Water Insoluble Substrate

The inventive substantially dry wiping article contains a water insoluble substrate as a component. By "water insoluble" is meant the substrate does not dissolve or readily break apart upon immersion in water. A wide variety of materials can be used as the substrate. The following non-limiting characteristics are desirable: (i) sufficient wet strength for use, (ii) sufficient abrasivity, (iii) sufficient loft and porosity, (iv) sufficient thickness, and (v) appropriate size. Sufficient abrasivity is herein defined as that level sufficient to provide exfoliation benefits to the user without scratching the skin.

Non-limiting examples of suitable insoluble substrates which meet the above criteria include non-woven substrates, woven substrates, hydro-entangled substrates, air-entangled substrates, needle-punched substrates, and the like. Preferred embodiments employ non-woven substrates since they are economical and readily available in a variety of materials. By non-woven is meant that the layer is comprised of fibers which are not woven into a fabric but rather are formed into a sheet, particularly a tissue. The fibers can either be random (i.e., randomly aligned) or they can be carded (i.e. combed to be oriented in primarily one direction). Furthermore, the non-woven substrate can be composed of a combination of layers of random and carded fibers.

Non-woven substrates may be comprised of a variety of materials both natural and synthetic. By natural is meant that the materials are derived from plants, animals, insects or byproducts. By synthetic is meant that the materials are obtained primarily from various man-made materials or from material that is usually a fibrous web comprising any of the common synthetic or natural textile-length fibers, or mixtures thereof.

Non-limiting examples of natural materials useful as components in the present invention are silk fibers, keratin fibers and cellulosic fibers. Non-limiting examples of keratin fibers include those selected from the group consisting of wool fibers, camel hair fibers, and the like. Non-limiting examples of cellulosic fibers include those selected from the group consisting of wood pulp fibers, cotton fibers, hemp fibers, jute fibers, flax fibers, and mixtures thereof. Cellulosic and polyester fibers are preferred.

Non-limiting examples of synthetic materials useful as components in the present invention include those selected from the group consisting of acetate fibers, acrylic fibers, cellulose ester fibers, modacrylic fibers, polyamide fibers, polyester fibers, polyolefin fibers, polyvinyl alcohol fibers, rayon fibers and mixtures thereof. Examples of some of these synthetic materials include acrylics such as Acrilan®, Creslan®, and the acrylonitrile-based fiber, Orlon®; cellulose ester fibers such as cellulose acetate, Arnel®, and Acele®; polyamides such as Nylons (e.g., Nylon 6, Nylon 66, Nylon 610 and the like; polyesters such as Fortrel®, Kodel®, and the polyethylene terephthalate fibers, Dacron®; polyolefins such as polypropylene, polyethylene; polyvinyl acetate fibers and mixtures thereof.

Non-woven substrates made from natural materials consist of webs or sheets most commonly formed on a fine wire screen from a liquid suspension of the fibers. Substrates made from natural materials useful in the present invention can be obtained from a wide variety of commercial sources.

Non-woven substrates that are preferred for the present invention have a sufficient level of porosity or air permeability to allow substantial quantities of lather to be produced when the substrate is impregnated with lathering surfactants and rubbed with water. Air permeability is influenced by an number of factors including the size and density of apertures in the fabric if present, the density of the fiber bat, the morphology of the fibers and their distribution, the degree and nature of fiber bonding, combinations of the foregoing factors, and the like. Air permeability can be measured by airflow and/or air pressure differential measurements, optical density or clarity measures, and other suitable art recognized measurements.

In addition, non-woven substrates that are preferred for the present invention have a sufficient percentage level of wet flexibility which is defined as the ability of the substrate to substantially return to its original shape after being crushed, while saturated with water during use. Substantially returning to its original shape is herein defined as the fabric returning to at least 30 percent, preferably 40 percent of its original z-axis dimension using a suitable loading and unloading bulk test such as the following. Submerse a sample in a pan of water for about 2 seconds and remove the excess water by contacting the sample on both sides with blotter paper. Measure the sample thickness or z-axis distance at increasing incremental loads of 0.10 to 3.0 PSI followed by decreasing incremental loads of 2.5 to 0.10 PSI. Calculate the % wet flexibility (or % z-axis recovery) by dividing the z-axis recovery distance by the z-axis maximum compression displacement distance, the result then multiplied by 100. The z-axis recovery distance is obtained as the difference in height between the unloaded sample recovery height and the sample height at 3.0 PSI loading.

Techniques to impart wet flexibility to woven and non-woven fabrics are well known in the art. Art recognized methods to improve wet flexibility of non-wovens include 1) increasing the level of latex, acrylic, or other binders; 2) laminating two or more substrates together; 3) employing longer and/or stiffer fibers; 4) employing larger diameter fibers; or 5) modifying the manufacturing processes such as by employing needle-punching to form a stiffer fabric, or using any combination of the foregoing and the like.

Non-woven substrates of the instant invention can comprise a repeating pattern of at least two adjacent regions in which the first region has a mean thickness from about 0.025 cm to about 1.0 cm, and in which the second region has a mean thickness from about 0.010 cm to about 0.50 cm, preferably from about 0.025 cm to about 0.2 cm. In addition or alternatively, the non-woven substrate can have a series of regularly or irregularly spaced apertures or voids. Furthermore, in any of the embodiments, the non-woven substrate can also comprise raised nubs or bumps. When the non-woven substrate contains apertures, these apertures are preferably regularly spaced and each have an area from about 0.15 $mm^2$ to about 5 $mm^2$ more preferably from about 0.20 $mm^2$ to about 4 $mm^2$, and most preferably from about 0.20 $mm^2$ to about 3.5 $mm^2$. The apertures, when present, comprise from about 1% to about 50%, preferably from about 5% to about 40%, and most preferably from about 8% to about 35% of the total surface area of said non-woven substrate. Most preferably the center-line to center-line distance between the nubs and the apertures is equal to about 1.0 cm.

Non-woven substrates made from synthetic material useful in the present invention can also be obtained from a wide variety of commercial sources, such as e.g. Sontaro® type fabric, a hydro-entangled material, containing about 50% cellulose and about 50% polyester, and having a basis weight of about 60 gsy or 2.2 oz per sq. yard, having rectangular apertures of about 1.5 mm by 2 mm in dimension with about 150 to 160 apertures per sq. inch, available from Dupont Chemical Corp; PGI Lavett fabric, a 2.35 oz/sq. yd., 63% rayon/29% PET/8% binder fabric with rectangular apertures of about 2 mm×3 mm in dimension having about 40 to 45 apertures per square inch from PGI Corporation; a Carlee high loft fabric, 2.0 oz/sq. yd., 100% polyester fabric from Carlee Corporation; and KC 5A high loft fabric, approx. 2.5 oz per sq. yard, 100% polyester fabric from Kimberly Clark Corporation. A preferred fabric is the Miratec® fabric N2027, with an overall basis weight of 3.4 oz./sq. yd. with the following fiber content: 0.75 oz./sq. yd. of 100% Spunbond PET on the bottom or flat side; 1.375 oz./sq. yd. of 90% PET fiber/10% Rayon in the middle; and 1.375 oz./sq. yd. of 100% PET on the top or image side from PGI Corporation and made according to the processes described in U.S. Pat. Nos. 5,098,764; 5,244,711; 5,674,587; and 5,674,591 which are herein incorporated by reference. A minimum of about 3.5% Rayon is preferably located as close to the side to be coated with lathering surfactant as possible.

Most preferred as a component substrate for purposes of this invention are hydroentangled non-woven substrates, especially all polyester or blends of rayon/polyester and cellulosic fiber/polyester. The fiber content may also be advantageously varied along the z axis of the non-woven substrate. The blends are advantageously in ratios of about 10:90 to about 90:10 by weight. Most useful substrates having at least a layer of about 10% rayon/90% polyester and have an overall basis weight of about 2 to 4 oz./sq. yard, preferably about 3 to 4 oz./sq. yard, and most preferably about 3.5 oz./sq. yard. Anywhere from about 1 to about 100, preferably from about 5 to about 50 single wiping articles may be stored within the dispenser.

Lathering Surfactant

The inventive wiping article also contains a lathering surfactant. By a "lathering surfactant" is meant a surfactant, which when combined with water and mechanically agitated generates a foam or lather. Preferably, these lathering surfactants should be mild, which means that they must provide sufficient cleansing or detersive benefits but not overly dry the skin or hair, and yet meet the lathering criteria described above.

The products of the present invention typically comprise a lathering surfactant to substrate weight ratio is advantageously between about 0.005 to about 2, preferably between about 0.05 to about 1.5, and more preferably from about 0.1 to about 1.0. Advantageously, about 3.4 to 4.5 gms of the cleansing composition, preferably at least about 4.2 gms are added to a non-woven substrate which weighs in the range of about 4.2–4.5 gms.

A wide variety of lathering surfactants are useful herein and include those selected from the group consisting of anicnic, nonionic, cationic, amphoteric and lathering surfactant mixtures thereof.

Among the anionic lathering surfactants useful herein are the following non-limiting examples that include the classes of:

(1) Alkyl benzene sulfonates in which the alkyl group contains from 9 to 15 carbon atoms, preferably 11 to 14 carbon atoms in straight chain or branched chain configuration. Especially preferred is a linear alkyl benzene sulfonate containing about 12 carbon atoms in the alkyl chain.

(2) Alkyl sulfates obtained by sulfating an alcohol having 8 to 22 carbon atoms, preferably 12 to 16 carbon atoms. The alkyl sulfates have the formula $ROSO_3_M^+$ where R is the $C_{8-22}$ alkyl group and M is a mono- and/or divalent cation.

(3) Paraffin sulfonates having 8 to 22 carbon atoms, preferably 12 to 16 carbon atoms, in the alkyl moiety. These surfactants are commercially available as Hostapur SAS from Hoechst Celanese.

(4) Olefin sulfonates having 8 to 22 carbon atoms, preferably 12 to 16 carbon atoms. Most preferred is sodium $C_{14}$–$C_{16}$ olefin sulfonate, available as Bioterge AS 40®

(5) Alkyl ether sulfates derived from an alcohol having 8 to 22 carbon atoms, preferably 12 to 16 carbon atoms, ethoxylated with less than 30, preferably less than 12, moles of ethylene oxide. Most preferred is sodium lauryl ether sulfate formed from 2 moles average ethoxylation, commercially available as Standopol ES-2®.

(6) Alkyl glyceryl ether sulfonates having 8 to 22 carbon atoms, preferably 12 to 16 carbon atoms, in the alkyl moiety.

(7) Fatty acid ester sulfonates of the formula: $R^1CH(SO_3_M+)CO_2R^2$ where $R^1$ is straight or branched alkyl from about $C_8$- to $C_{18}$, preferably $C_{12}$ to $C_{16}$, an $dR^2$ is straight or branched alkyl from about $C_1$ to $C_6$, preferably primarily $C_1$, and M+ represents a mono- or divalent cation.

(8) Secondary alcohol sulfates having 6 to 18, preferably 8 to 16 carbon atoms.

(9) Fatty acyl isethionates having from 10 to 22 carbon atoms, with sodium cocoyl isethionate being preferred.

(10) Dialkyl sulfosuccinates wherein the alkyl groups range from 3 to 20 carbon atoms each.

(11) Alkanoyl sarcosinates corresponding to the formula $RCON(CH_3)CH_2CH_2CO_2M$ wherein R is alkyl or alkenyl of about 10 to about 20 carbon atoms and M is a water-soluble cation such as ammonium, sodium, potassium and trialkanolammonium. Most preferred is sodium lauroyl sarcosinate.

(12) Alkyl lactylates wherein the alkyl groups range from 8 to 18 carbon atoms, with sodium lauryl lactylate sold as Pationic 138 C® available from the Patterson Chemical Company as the most preferred.

(13) Taurates having from 8 to 16 carbon atoms, with cocoyl methyl taurate being preferred.

Nonionic lathering surfactants suitable for the present invention include $C_{10}$–$C_{20}$ fatty alcohol or acid hydrophobes condensed with from 2 to 100 moles of ethylene oxide or propylene oxide per mole of hydrophobe; $C_2$–$C_{10}$ alkyl phenols condensed with from 2 to 20 moles of alkylene oxides; mono- and di-fatty acid esters of ethylene glycol such as ethylene glycol distearate; fatty acid monoglycerides; sorbitan mono- and di-$C_8$–$C_{20}$ fatty acids; and polyoxyethylene sorbitan available as Polysorbate 80 and Tween 80® as well as combinations of any of the above surfactants.

Other useful nonionic surfactants include alkyl polyglycosides, saccharide fatty amides (e.g. methyl gluconamides) as well as long chain tertiary amine oxides. Examples of the latter category are: dimethylododecylamine oxide, oleyldi(2-hydroxyethyl)amine oxide, dimethyloctylamine oxide, dimethyldecylamine oxide, dimethyltetradecylamine oxide, di(20-hydroxyethyl)tetradecylamine oxide, 3-didodecyoxy-2-hydroxypropyldi(3-hydroxypropyl)amine oxide, and dimethylhexadecylamine oxide.

Amphoteric lathering surfactants useful for the present invention include aliphatic secondary and tertiary amines, preferably wherein the nitrogen is in a cationic state, in which the aliphatic radicals can be straight or branched chain and wherein one of the radicals contains an ionizable water solubilizing group such as carboxy, sulphonate, sulphate, phosphate or phosphonate. Illustrative substances are cocoamidopropyl betaine, cocoamphoacetate, cocoamphodiacetate, cocoamphopropionate, cocoamphodipropionate, cocoamidopropyl hydroxysultaine, cetyl dimethyl betaine, cocoamidopropyl PG-dimonium chloride phosphate, coco dimethyl carboxymethyl betaine, cetyl dimethyl betaine and combinations thereof.

The amount of lathering surfactant to substrate weight ratio advantageously between about 0.005 to 2, preferably between about 0.05 to 1, and more preferably from about 0.1 to 0.5.

A humectant is optionally incorporated with compositions of the present invention. Humectants are normally polyols. Representative polyols include glycerin, diglycerin, polyalkylene glycols and more preferably alkylene polyols and their derivatives including propylene glycol, dipropylene glycol, polypropylene glycol, polyethylene glycol and derivatives thereof, sorbitol, hydroxypropyl sorbitol, hexylene glycol, 1,2-butylene glycol, 1,2,6-hexanetriol, isoprene glycol, ethoxylated glycerol, propyoxylated glycerol and mixtures thereof. The most preferred is 2-methyl-1,3-propanediol available as MP Diol from the Arco Chemical Company. Amounts of the polyol may range from about 0.5 to about 95%, preferably from about 1 to about 50%, more preferably from about 1.5 to 20%, optimally from about 3 to about 10% by weight of the deposited composition.

Skin Conditioning Agents

Skin conditioning agents or emollients may be advantageously used in the present invention. The emollient "composition" may be a single benefit agent component or it may be a mixture of two or more compounds one or all of which may have a beneficial aspect. In addition, the benefit agent itself may act as a carrier for other components one may wish to add to the inventive toilet bar.

Hydrophobic emollients, hydrophilic emollients, or a blend thereof may be used. Preferably, hydrophobic emollients are used in excess of hydrophilic emollients in the inventive toilet bar composition. Hydrophobic emollients are preferably present in a concentration greater than about 5% by weight of the cleansing composition used to impregnate the water insoluble substrate, more preferably greater than about 10% by weight. The term "emollient" is defined as a substance which softens or improves the elasticity, appearance, and youthfulness of the skin (stratum corneum) by either increasing its water content, adding, or replacing lipids and other skin nutrients; or both, and keeps it soft by retarding the decrease of its water content.

Useful emollients include the following:

(a) silicone oils and modifications thereof such as linear and cyclic polydimethylsiloxanes; amino, alkyl, alkylaryl, and aryl silicone oils. Silicones of a volatile and non-volatile variety are included. Typical volatile silicones are the cyclomethicones commercially available as Dow Corning 244, 245, 344 and 345. Linear volatile dimethicones are also suitable. Non-volatile silicones include polydimethyl siloxanes of a viscosity greater than 2 centistoke and silicone copolyols also known as dimethicone copolyol for which Dow Corning 193 is a commercial source.

(b) fats and oils including natural fats and oils such as jojoba, soybean, sunflower, rice bran, avocado, almond, olive, sesame, persic, castor, coconut, mink oils; cacao fat; beef tallow, lard; hardened oils obtained by hydrogenating the aforementioned oils; and synthetic mono, di and triglycerides such as myristic acid glyceride and 2-ethylhexanoic acid glyceride;

(c) waxes such as carnauba, spermaceti, beeswax, lanolin, and derivatives thereof;

(d) hydrophobic and hydrophillic plant extracts;

(e) hydrocarbons such as liquid paraffins, vaseline®, microcrystalline wax, ceresin, squalene, pristan and mineral oil;

(f) higher alcohols such as lauryl, cetyl, stearyl, oleyl, behenyl, cholesterol and 2-hexydecanol alcohol;

(g) esters such as cetyl octanoate, myristyl lactate, cetyl lactate, isopropyl myristate, myristyl myristate, isopropyl palmitate, isopropyl adipate, butyl stearate, decyl oleate, cholesterol isostearate, glycerol monostearate, glycerol distearate, glycerol tristearate, alkyl lactate, alkyl citrate and alkyl tartrate;

(h) essential oils and extracts thereof such as mentha, jasmine, camphor, white cedar, bitter orange peel, ryu, turpentine, cinnamon, bergamot, citrus unshiu, calamus, pine, lavender, bay, clove, hiba, eucalyptus, lemon, starflower, thyme, peppermint, rose, sage, sesame, ginger, basil, juniper, lemon grass, rosemary, rosewood, avocado, grape, grapeseed, myrrh, cucumber, watercress, calendula, elder flower, geranium, linden blossom, amaranth, seaweed, ginko, ginseng, carrot, guarana, tea tree, jojoba, comfrey, oatmeal, cocoa, neroli, vanilla, green tea, penny royal, aloe vera, menthol, cineole, eugenol, citral, citronelle, borneol, linalool, geraniol, evening primrose, camphor, thymol, spirantol, penene, limonene and terpenoid oils;

(i) lipids such as cholesterol, ceramides, sucrose esters and pseudo-ceramides as described in European Patent Specification No. 556,957;

(j) vitamins, minerals, and skin nutrients such as milk, vitamins A, E, and K; vitamin alkyl esters, including vitamin C alkyl esters; magnesium, calcium, copper, zinc and other metallic components;

(k) sunscreens such as octyl methoxyl cinnamate (Parsol MCX) and butyl methoxy benzoylmethane (Parsol 1789);

(l) phospholipids;

(m) antiaging compounds such as alpha hydroxy acids, beta hydroxy acids; and (n) mixtures of any of the foregoing components, and the like.

Preferred emollient benefit agents are selected from triglyceride oils, mineral oils, petrolatum, and mixtures thereof. Especially preferred are triglyceride oils.

Cationic Conditioning Agents

Cationic conditioning agents in monomeric and polymeric type are also useful for purposes of this invention. Examples of the polymeric type include: cationic protein derivatives (e.g. Mackpro WWP manufactured by McIntyre Co.), cationic cellulose derivatives, cationic starches, copolymers of a diallyl quaternary ammonium salt and an acryl amide, quaternized vinylpyrrolidone, vinylimidazole polymers, polyglycol amine condensates. quaternized collagen polypeptide, polyethylene imine, cationized silicone polymer (e.g. Amodimethicone), cationic silicone polymers provided in a mixture with other components under the trademark Dow Corning 929 (cationized emulsion), copolymers of adipic acid and dimethylaminohydroxypropyl diethylenetriamine, cationic chitin derivatives, cationized guar gum (e.g. Jaguar C-B-S, Jaguar C-17, Jaguar C-16 etc. manufactured by the Celanese Company), quaternary ammonium salt polymers (e.g. Mirapol A-15, Mirapol AD-1, Mirapol AZ-1, etc., manufactured by the Miranol Division of the Rhone Poulenc Company). Amino silicone quats may similarly be employed. Most preferred is Silquat AD designated by the CTFA as Silicone Quaternium 8, available from Siltech Inc. Amounts of each cationic agent may range from about 0.01 to 5%, preferably from about 0.1 to about 4%, optimally from about 0.3 to about 3.5% by weight of the composition impregnated in the substrate.

The disposable, single use personal care cleansing products of the present invention are manufactured by separately or simultaneously adding onto or impregnating into a water insoluble substrate a lathering surfactant and a skin conditioning agent, wherein the resulting product is substantially dry. By "separately" is meant that the surfactants and skin conditioning agents can be added sequentially, in any order without first being combined together. By "simultaneously" is meant that the surfactants and skin conditioning agents can be added at the same time, with or without first being combined together.

The surfactant, skin conditioning agents and any optional ingredients can be added onto or impregnated into the water insoluble substrate by any means known to those skilled in the art. For example, addition can be through spraying, laser printing, splashing, dipping, soaking, or coating.

When water or moisture is used or present in the manufacturing process, the resulting treated substrate is then dried so that it is substantially free of water. The treated substrate can be dried by any means known to those skilled in the art. Non-limiting examples of known drying means include the use of convection ovens, radiant heat sources, microwave ovens, forced air ovens, and heated rollers or cams. Drying also includes air drying without the addition of heat energy, other than that present in the ambient environment. Also, a combination of various drying methods can be used.

Except in the operating and comparative examples, or where otherwise explicitly indicated, all numbers in this description indicating amounts of material ought to be understood as modified by the word "about".

The following example will more fully illustrate preferred embodiments of this invention. All parts, percentages and proportions referred to herein and in the appended claims are by weight unless otherwise illustrated. Physical test methods are described below:

EXAMPLE

Substantially dry wiping articles suitable for use with the inventive personal cleansing system were produced by saturating two samples of Miratec® fabric N2027 hydroentangled, non-woven substrates (as shown in FIGS. 13 to 15) having an overall basis weight of about 3.5 oz./sq. yard with Cleansing composition A and B as shown in tables 1 and 2 respectively. The non-woven substrate had nubs composed of the same substrate distributed uniformly on one side of about 0.5 cm in diameter and about 0.2 cm in height above the non-woven substrate surface at a density of about 2.0 to 2.5 nubs per $cm^2$. In addition, the non-woven substrate had generally oval apertures uniformly distributed around the nubs of about 1×3 mm in dimension at a density of about 2.0 to 2.5 apertures per $cm^2$. The center-line to center-line distances of the nubs and of the apertures was approximately 1.0 cm for each. Each sheet (about 7×8 inch in rectangular dimension) weighed in the range of about 4.2–4.5 gms and was impregnated with about 4.2 gms of the cleansing composition.

TABLE 1

Cleansing Composition A

| Component | Concentration (wt. %) |
|---|---|
| Polyquaternium-10 | 0.1 to 1.0 |
| Hydroxy Methyl Cellulose | 0.1 to 1.0 |
| Maltodextrin | 0.1 to 1.0 |
| Sodium Laureth Sulfate | 25.0 to 35.0 |
| Cocoamidopropyl Betaine | 10.0 to 25.0 |

TABLE 1-continued

Cleansing Composition A

| Component | Concentration (wt. %) |
|---|---|
| Mono and Diester Lauryl Alkyl Phosphate | 0.5 to 3.0 |
| Sodium C14–16 Alpha Olefin Sulfonate | 0.5 to 3.0 |
| Sodium Lauryl Sulfate | 1.0 to 5.0 |
| C12–14 Alkyl Alcohol | 0.1 to 1.0 |
| Hydrolyzed Cationic Wheat Protein | 1.0 to 5.0 |
| Triglyceride Oil | 5.0 to 25.0 |
| C12–C15 Alkyl Benzoate | 1.0 to 5.0 |
| Glycerin | 0.001 to 1.0 |
| Tetra Ammonium EDTA | 0.001 to 1.0 |
| Glydant preservative | 0.001 to 1.0 |
| Caprylic/Capric Triglycirides | 1.0 to 5.0 |
| Fragrance | 0.001 to 5.0 |
| Miscellaneous ingredients and skin benefit agents | 0.001 to 5.0 |
| Hexylene Glycol | to 100% |

TABLE 2

Cleansing Composition B

| Component | Concentration (wt. %) |
|---|---|
| Guar Gum, 2 Hydroxy-3-(trimethylammonio) propyl ether, Chloride | 0.1 to 3.0 |
| Hydroxy Methyl Cellulose | 0.1 to 3.0 |
| Polyethylene glycol | 0 to 8 |
| Maltodextrin | 0.1 to 15.0 |
| Sodium Laureth Sulfate | 10.0 to 35.0 |
| Cocoamidopropyl Betaine | 1.0 to 25.0 |
| Mono and Diester Lauryl Alkyl Phosphate | 0.5 to 7.0 |
| Sodium C14–16 Alpha Olefin Sulfonate | 0.5 to 8.0 |
| Di-Sodium Dimethicone Copolyol Sulfosuccinate | 1.0 to 10.0 |
| Sodium Lauryl Sulfate | 1.0 to 25.0 |
| Cocoamide monoethanolamide | 1.0 to 8.0 |
| C12–14 Alkyl Alcohol | 0.1 to 8.0 |
| Hydrolyzed Cationic Wheat Protein | 1.0 to 5.0 |
| Mineral Oil | 0.0 to 8.0 |
| Triglyceride Oil | 3.0 to 25.0 |
| C12–C15 Alkyl Benzoate | 1.0 to 5.0 |
| Glycerin | 0.1 to 15 |
| Emulsifiers | 0.1 to 1.0 |
| Tetra Ammonium EDTA | 0.001 to 1.0 |
| preservative | 0.001 to 1.0 |
| Caprylic/Capric Triglycerides | 1.0 to 5.0 |
| Fragrance | 0.001 to 5.0 |
| Miscellaneous ingredients and skin benefit agents | 0.001 to 5.0 |
| 2-methyl-1,3-propanediol | to 100% |

While this invention has been described with respect to a particular embodiments thereof, it is apparent that numerous other forms and modifications of the invention will be obvious to those skilled in the art.

We claim:

1. A method for cleansing a human body within a water shower installation, comprising the steps of:

(a) providing a dispenser for a plurality of substantially dry, single use disposable wiping articles, each of the articles comprising a water-insoluble substrate and a lathering surfactant, the dispenser being water impermeable; the dispenser including:

a shell enclosing the plurality of wiping articles, a slot formed along the shell having an opening bounded by a closure means displaceable between an open and a closed position, the open position allowing removal of the wiping articles, wherein the slot is situated adjacent to a bottom surface of the dispenser; and a support device secured to the shell;

(b) securing the dispenser via the support device to a member of the shower installation;

(c) removing a wiping article from the dispenser;

(d) lathering with water the removed wiping article;

(e) applying the lathered article to the body; and (f) rinsing the lathered body with a water spray.

2. The method according to claim 1 wherein the wiping article meets a Moisture Retention value of less than about 0.3 gms.

3. The method according to claim 1 wherein the lathering surfactant concentration is in the range of about 0.1 to about 40% by weight of the wiping article.

4. The method according to claim 1 wherein the wiping article further comprises a skin conditioning agent other than a C8–C20 fatty acid in an amount from about 0.1 to about 40% by weight of the wiping article.

5. The method according to claim 1 wherein the support device is selected from mechanical couplers, suction couplers, adhesive, magnetic couplers, and combinations thereof.

6. The method according to claim 5 wherein the support device is selected from a hook, an adhesive, a closure consisting of a fabric of small hooks that sticks to a corresponding fabric of small loops, a cord and combinations thereof.

7. The method according to claim 1 wherein the plurality of wiping articles ranges in number from about 2 to about 100.

8. The method according to claim 1 wherein the dispenser prevents shower water from entering to an extent that any of the plurality of wiping articles absorb no more than about 5% by weight shower water per article during the rinsing step.

9. The method according to claim 1 wherein the dispenser has a single slot.

* * * * *